US006988979B1

(12) United States Patent
Trainor

(10) Patent No.: US 6,988,979 B1
(45) Date of Patent: Jan. 24, 2006

(54) CELLULITE REDUCING BENCH

(76) Inventor: Wendi Trainor, 667 Coates La., King of Prussia, PA (US) 19406

( * ) Notice: Subject to any disclaimer, the term of this patent is extended or adjusted under 35 U.S.C. 154(b) by 0 days.

(21) Appl. No.: 10/653,629

(22) Filed: Sep. 2, 2003

(51) Int. Cl.
*A63B 26/00* (2006.01)

(52) U.S. Cl. ..... 482/142; 482/148; 601/23; 601/24

(58) Field of Classification Search ..... 482/142, 482/148, 907; 601/23, 24; 5/279
See application file for complete search history.

(56) References Cited

U.S. PATENT DOCUMENTS

| | | | | | |
|---|---|---|---|---|---|
| 3,756,224 | A | | 9/1973 | Laymon | |
| 3,970,078 | A | | 7/1976 | Rogers, Jr. | |
| 4,086,922 | A | | 5/1978 | Henderson | |
| 4,157,712 | A | | 6/1979 | Gaynor | |
| 4,614,000 | A | | 9/1986 | Mayer | |
| D294,212 | S | | 2/1988 | Sias et al. | |
| 5,134,735 | A | | 8/1992 | Rose | |
| 5,170,778 | A | | 12/1992 | Jamis | |
| 5,250,067 | A | | 10/1993 | Gelfer et al. | |
| 5,393,287 | A | * | 2/1995 | Papapaschalis | 482/142 |
| 5,402,545 | A | | 4/1995 | Jolley | |
| 5,595,141 | A | * | 1/1997 | Udelle et al. | 119/706 |
| 5,628,079 | A | | 5/1997 | Kizemchuk et al. | |
| 5,672,144 | A | * | 9/1997 | Hulme | 482/140 |
| 5,755,647 | A | * | 5/1998 | Watnik | 482/121 |
| 5,820,573 | A | | 10/1998 | Ramos | |
| 5,823,595 | A | * | 10/1998 | Tronco | 296/26.03 |
| 5,830,161 | A | | 11/1998 | Cosmano | |
| D416,739 | S | | 11/1999 | Denney et al. | |
| D416,740 | S | | 11/1999 | Denney et al. | |
| D416,741 | S | | 11/1999 | Denney et al. | |
| D417,355 | S | | 12/1999 | Denney et al. | |
| 6,305,040 | B1 | | 10/2001 | Myler | |
| 6,443,914 | B1 | | 9/2002 | Costantino | |
| 6,511,445 | B2 | | 1/2003 | Sivan et al. | |
| 6,517,499 | B1 | | 2/2003 | Pereira | |

OTHER PUBLICATIONS

Snukkles Baby Massager Web Page, www.comfortchannel-.com/prod.itml/icOid/1555, Sep. 17, 2003.
Nukkles Hand held Massage Tool Web Page, www.comfortchannel.com/prod.itml/icOid/519, Sep. 17, 2003.

* cited by examiner

*Primary Examiner*—Gregory L. Huson
*Assistant Examiner*—L. Amerson
(74) *Attorney, Agent, or Firm*—Caesar, Rivise, Bernstein, Cohen & Pokotilow, Ltd

(57) ABSTRACT

An exercise bench for performing exercises for the reduction of cellulite which includes a frame having legs and a seating surface attached to the frame to support a body of a user. The seating surface is located at a height above a floor upon which the frame is placed that is greater than about twenty inches such that an average user's feet do not fully touch the surface upon which the frame is placed. A textured surface on the seating surface has a sufficient quantity and height of protuberances to enable reduction of cellulite when skin of the user is placed on the surface, the skin is kept relatively fixed relative to the textured surface, and the body of the user is moved relative to the textured surface such that fat tissue is moved relative to the textured surface. A method of using the bench is also provided.

9 Claims, 4 Drawing Sheets

CELLULITE REDUCING BENCH

BACKGROUND OF THE INVENTION

This invention relates to a method and apparatus for treating cellulite containing areas of the human body and, more particularly, to a method and apparatus for massaging areas of the body having cellulite therein to assist in temporarily reducing cellulite.

Cellulite is a condition of the body, more common to women than men. People may have this condition in numerous parts of the body, for example, on thighs, hips, stomach and upper arms, in the form of bulges, dimply and lumpy areas. "Overfat," "average fat" and even "under fat" people may have it. It is thought that cellulite is a build up of fat, body fluids and toxic residues trapped in the tissues, however, it apparently is not an ordinary fat as it cannot be lost by diet or exercise. The present invention is a method and apparatus for applying a messaging action to aid in breaking down the fat cells or nodes so that the fluids present therein can be absorbed into the blood stream and eliminated by the normal waste elimination process of the body.

It is well known that massage may diminish the appearance of cellulite. For example, many salons have massage services directed specifically to improving the appearance of cellulite. Additionally, a technique known as Endermology involves the use of a motorized device with two rollers and controlled suction to help improve the appearance of cellulite. U.S. Pat. No. 6,517,499 (Pereira), discloses a massage device with rotating elements. This is a hand held device with a suction enclosure. A reciprocating linear motion is communicated to massage applicator rollers to facilitate massaging human tissue in the treatment of cellulite.

Many other devices and methods for the reduction of cellulite are known. For example, U.S. Pat. No. 6,511,445 (Sivan, et al.) is directed to a hand-held cellulite massage system with a gel dispenser. The device applies suction to an area of the body to massage that area and applies gel to treat the skin.

U.S. Pat. No. 6,443,914 (Costantino) is directed to an apparatus and method for preventing and treating cellulite. Tissues are generated or strengthened by applying radiation or an appropriate frequency to disrupt or otherwise destroy cells.

U.S. Pat. No. 5,820,573 (Ramos) is directed to a body contour massage device and method where the device consists of a rigid flat base which, when configured with contoured modules and rigid pressure nibs or blades, contours the length of an adult human body. The device operates by arranging the massage elements including buttocks, back, shoulder and neck modules with pressure nibs or blades to match the contoured surface of the backside of a person. The person then lies upward facing on the device with the device applied across the entire body for the desired therapeutic effect. A specific object of the invention is to provide muscular therapy through non-motion massage. (See column 1, lines 66–67).

U.S. Pat. No. 5,402,545 (Jolley) teaches an orthopedic seat cushion for permitting free circulation and protecting the user's coccyx. A cushion with numerous protrusions is disclosed.

U.S. Pat. No. 5,628,079 (Kizemchuk et al.) is directed to a seat cushion with projections. The seat cushion has a flexible substrate and pads. The pads have a pattern of projections thereon in a spaced-apart relationship. Here, it is indicated that the cushion provides massage of a persons buttocks or thighs to help alleviate cellulite. However, again, no exercises or movement of the user relative to the cushion is taught.

U.S. Pat. No. 5,250,067 (Gelfer, et al.) is directed to a body treatment pad having a multiple number of sharpened skin-penetration protuberances. The pad includes a flexible backing sheet having a multiplicity of similarly constructed rigid blocks at spaced points along the sheet surface. Each block has at least one tapered protuberance extending away from the sheet. When the pad is held under pressure against a person's body, the sharpened protuberances act as acupuncture elements to stimulate nerve endings under the skin, thereby increasing the blood circulation and relieving pain.

U.S. Pat. No. 5,170,778 (Jamis) is directed to a body massaging device which permits a user to massage his back by placing the device between his back and the flat surface.

U.S. Pat. No. 5,134,735 (Rose) is directed to a mattress cushion with multiple zones. Each of the cushion's three separate zones has a different compression modulus such that as the person presses down on the zones, support proportional to the body's weight is achieved.

U.S. Des. Pat. No. 294,212 (Sias, et al.) is directed to a design of a seating pad having upwardly extending protuberances.

U.S. Pat. No. 4,614,000 (Mayer) is directed to patient undersheet for preventing bed sores that utilizes upwardly extending protuberances.

U.S. Pat. No. 4,086,922 (Henderson) is directed to a method and apparatus for treating cellulite containing areas of the human body. This is a hand-held device that uses a base that supports closely spaced balls. The apparatus is hand-held for massaging and kneading areas of the human body.

Finally, U.S. Pat. No. 3,970,078 (Rogers, Jr.) is directed to a hand roller massage device that is grasped by a hand and uses massage rollers to massage areas of the cellulite on a human body.

The principal object of the present invention is to provide for a special exercise bench for exercising and massaging of areas of the human body having cellulite therein.

All references cited herein are incorporated herein by reference in their entireties.

BRIEF SUMMARY OF THE INVENTION

An exercise bench for use in performing exercises for the temporary reduction of cellulite is provided which includes a frame having legs and a seating surface attached to the frame to support a body of a user. The seating surface is located at a height above a floor upon which the frame is placed that is greater than about twenty inches such that an average user's feet do not fully touch (i.e., the user's heels do not touch) the surface upon which the frame is placed. A textured surface on the seating surface has a sufficient quantity and height of protuberances to enable reduction of cellulite when skin of the user is placed on the surface, the skin is kept relatively fixed relative to the textured surface, and the body of the user is moved relative to the textured surface such that fat tissue is moved relative to the textured surface.

The seating surface is preferably located at a height above the floor of greater than twenty three inches. One or more fasteners may be used to allow for easy interchanging to alternate textured surfaces. The fasteners may be hook-and-loop type fasteners. The textured surface may be, for example, berber type carpeting or a weaved material (for example, braided rope). The protuberances may be randomly positioned or positioned in a non-random pattern. The protuberances of the textured surface may be in the form of nail-like shapes.

Optionally, the exercise bench may be designed such that is stackable with other exercise benches of the same design.

Additionally, a method for the treatment of cellulite for the temporary reduction thereof is provided which includes the steps of providing the above bench and moving legs of the user such that the skin of the buttocks and thighs of the user's body supported on the textured surface remains generally fixed relative to the textured surface but provides for movement of fat tissue beneath the skin, thereby possibly decreasing viscosity of a subcutaneous fat layer of the user and increasing blood flow whereby cellulite of the user is temporarily reduced. The step of moving the legs may include moving the legs in a back and forth from an extended leg position to a bent position. Movement of the two legs of the user may occur such that the user's two legs are extended and bent simultaneously or independently and alternately. The method may further include the step of placing leg weights on the user. The step of moving the legs of the user may include moving the body of the user by rolling the body from side-to-side. Finally, the method may include the steps of unfastening the textured surface, fastening a second textured surface, and repeating the step of moving the legs of the user.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The invention will be illustrated in more detail with reference to the following embodiment but it should be understood that the present invention is not deemed to be limited thereto.

Figures 1, 1A:
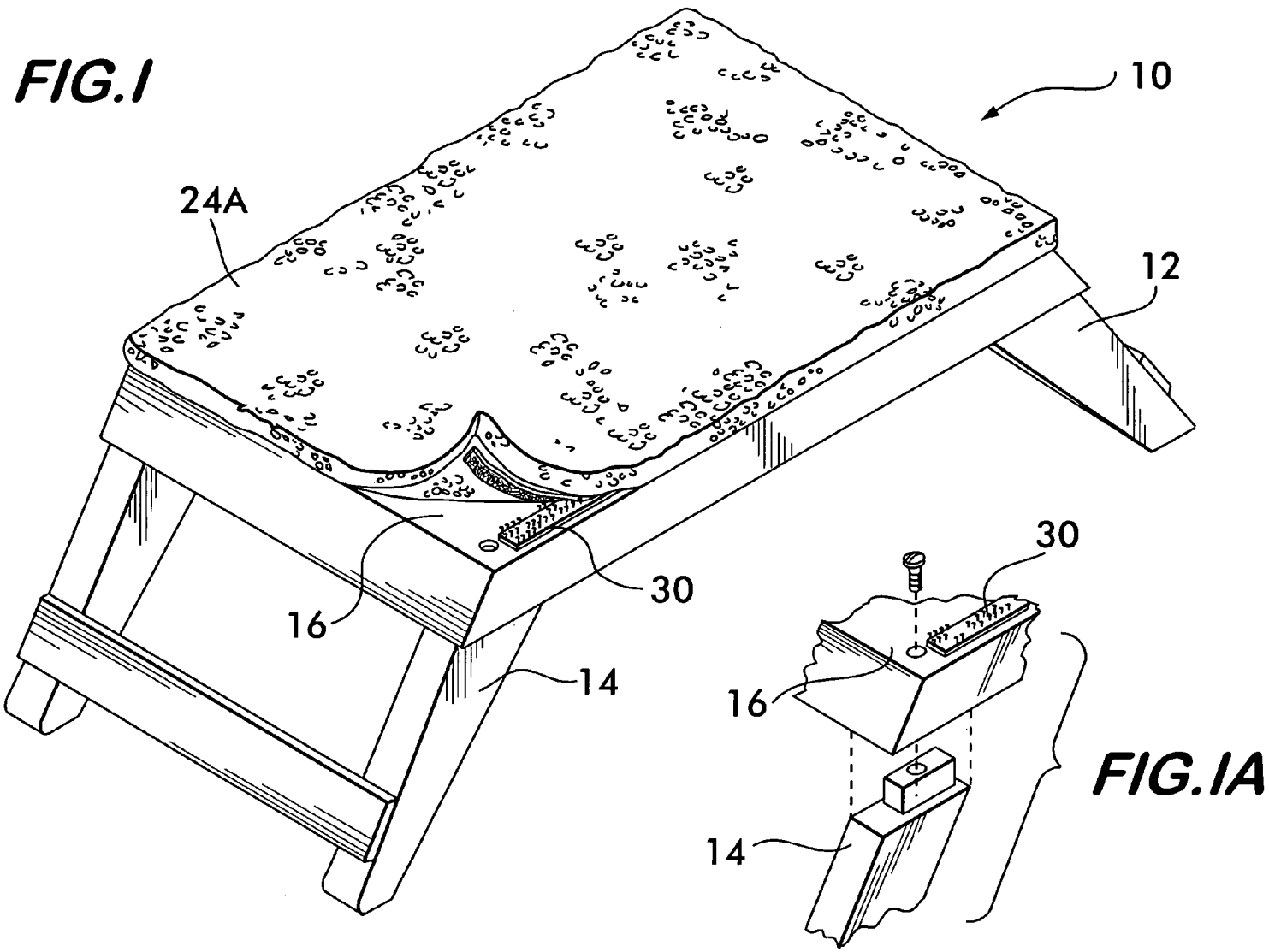
FIG. 1 is an isometric view of an exercise bench for use in performing exercises for the temporary reduction of cellulite in accordance with one preferred embodiment of the present invention.
FIG. 1A is an isometric detail view of a preferred leg assembly of the exercise bench of FIG. 1.
Figure 2:
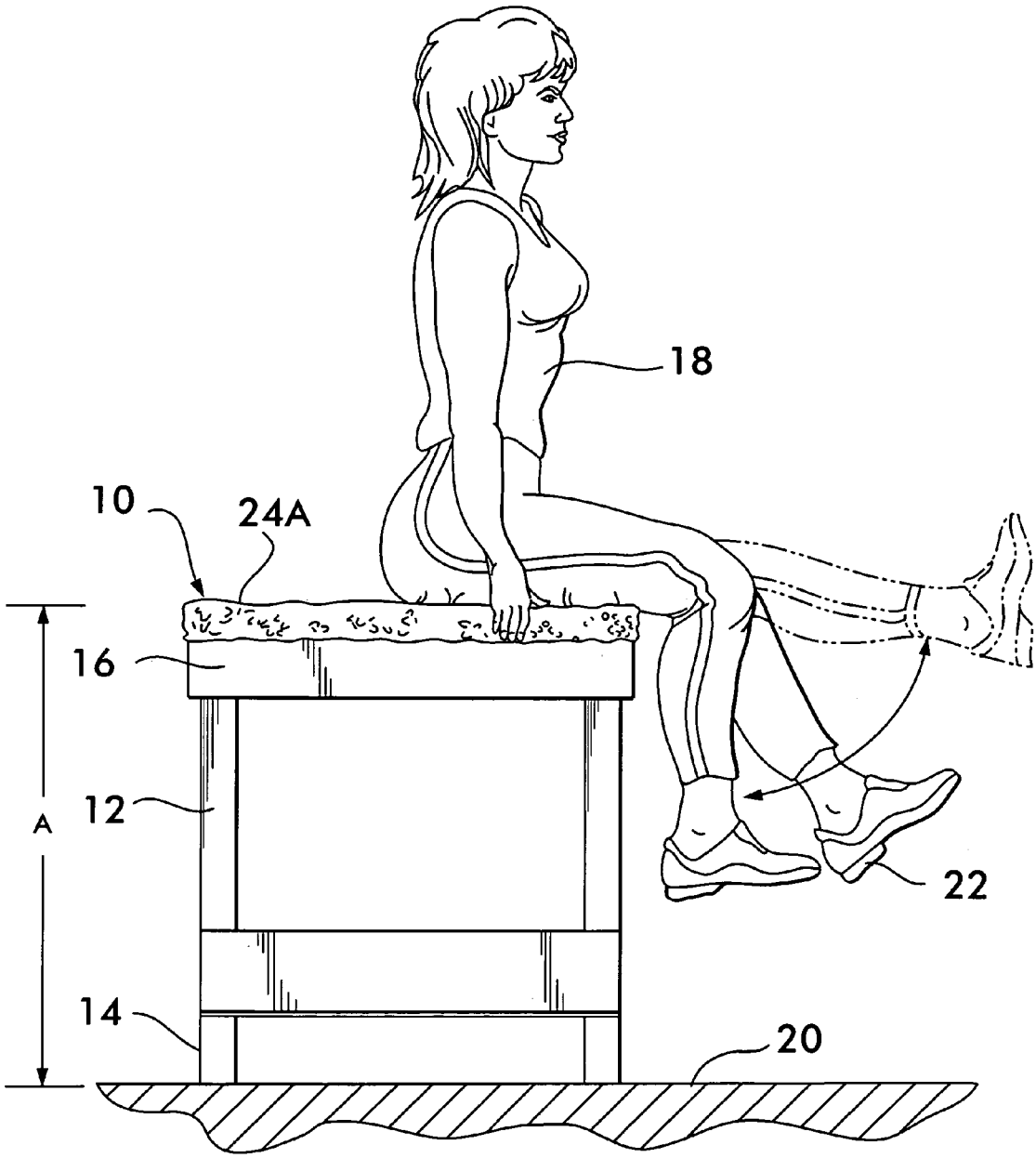
FIG. 2 is a side elevation view of the exercise bench for use in performing exercises of FIG. 1, depicting a user performing exercises to reduce the appearance of cellulite.

Referring now to the drawings, wherein like part numbers refer to like elements throughout the several views, there is shown in FIGS. 1 and 2 an exercise bench 10 for use in performing exercises for the temporary reduction of cellulite. The exercise bench 10 includes a frame 12 having legs 14 and a seating surface 16 attached to the frame 12 to support a user 18 on the frame 12. Importantly, the seating surface 16 is at a height A above the floor 20 upon which the frame 12 is placed such that the user's feet 22 are not fully supported on the floor 20. That is, the user's heels do not touch. Typically the height of the seating surface of a chair is about seventeen inches off the floor. The exercise bench of the present invention is somewhat higher than seventeen inches, for example, about twenty inches or more such that the user's legs are able to swing generally free of the floor to enable the user to perform exercises in accordance with the present invention.

Figure 3:
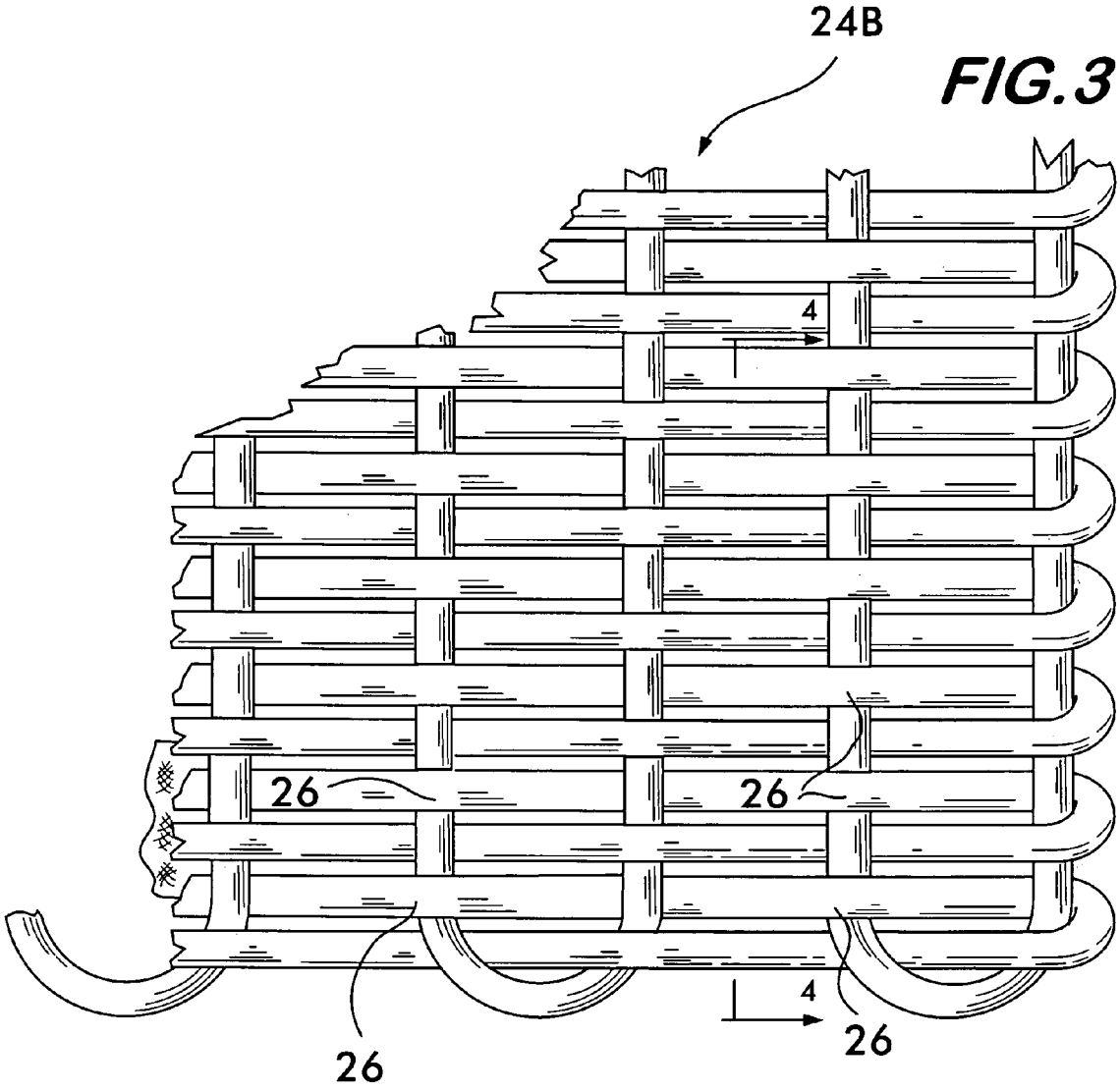
FIG. 3 is a partial plan view of one embodiment of a textured surface for use on the exercise bench of FIG. 1.
Figure 4:
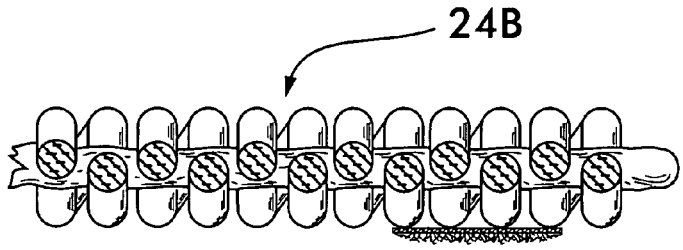
FIG. 4 is a partial cross-sectional view of the textured surface of FIG. 3, taken substantially along lines 4—4 of FIG. 3.
Figure 5:
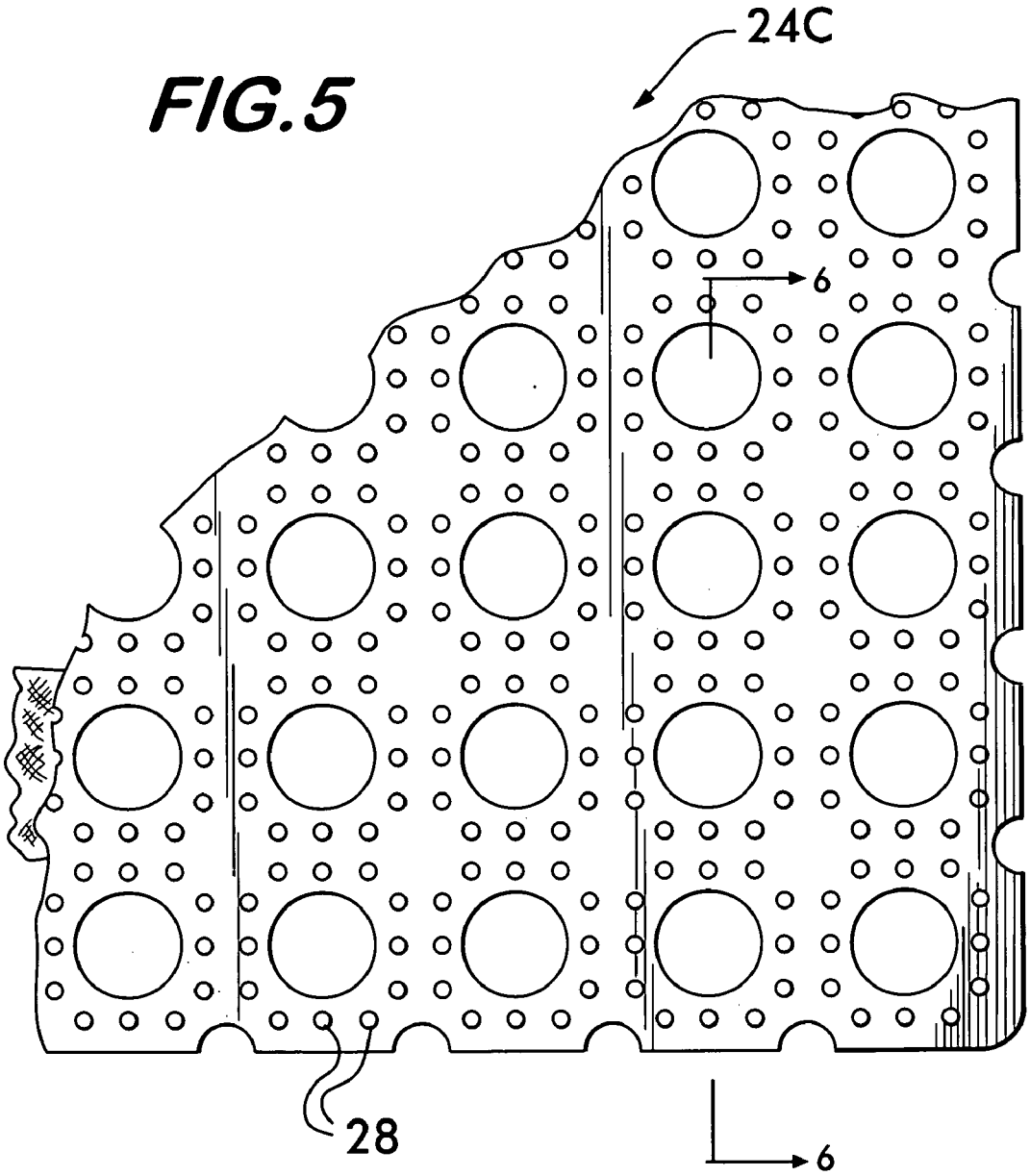
FIG. 5 is a partial plan view an alternate embodiment of textured surface for use on the exercise bench of FIG. 1.
Figure 6:
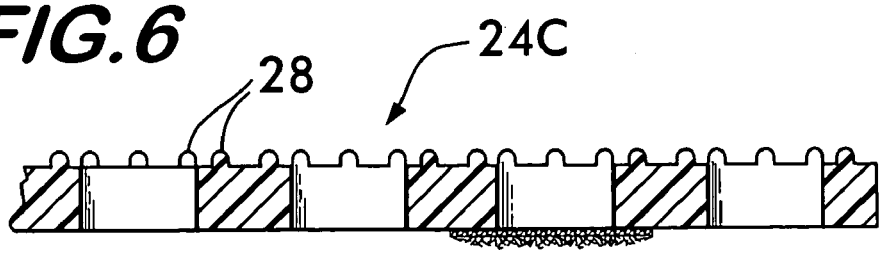
FIG. 6 is a partial cross-sectional view of the textured surface of FIG. 5, taken substantially along lines 6—6 of FIG. 5.

The seating surface 16 includes a textured surface 24A that is provided such that the user's buttocks and thighs sit directly on the textured surface 24A. The textured surface 24A has a sufficient quantity and height of protuberances, projections, or other type of rough surfaces to enable possible reduction of cellulite when skin of the user is placed in the surface and the body, but not the skin, is moved relative to the textured surface 24A. Preferably, the exercise bench 10 has provision to attach more than one textured surface 24A, for example, three or more different textured surfaces, for example, 24A as shown in FIGS. 1, 24B as shown in FIGS. 3–4, and 24C as shown in FIGS. 5 and 6. FIG. 1 shows an example of the textured surface 24A which may be in the form of, for example, a berber carpet-like texture. This textured surface 24A preferably does not contain any ancillary cushioning and has a pattern of protuberances on its material. FIGS. 3–4 and 5–6 depict two examples of other textured materials 24A and 24B suitable for use with the present invention. FIGS. 3 and 4 depict a second example of textured surface 24B which is in the form of "weave" in that it has the appearance of a braided rope. Preferably, the textured surface has a hard, but slippery feel when it comes into contact with, for example, nylon or spandex exercise tights. This textured surface may be constructed from, for example, nylon or other polymer rope, of about one-half inch diameter in, for example, a basket weave pattern, as shown. The pattern effectively provides a pattern of non-random protuberances 26. FIGS. 5 and 6 depict a third example of a textured surface 24C which is in the form of a pattern of nail-like protuberances 28. The pattern of nail-like protuberances 28 may be random or non-random.

A preferred embodiment of the exercise bench is a bench that has the textured surface 24A, 24B, 24C at a height A (see FIG. 2) that is approximately twenty-three inches above the surface upon which the bench 10 sits, twenty-three inches wide and thirty-six inches long. The height A of the bench 10 is the most critical dimension for purposes of the present invention. Here, as discussed above, seating surface 16 is at a height A above the floor 20 upon which the frame 12 is placed such that the user's feet 22 are not fully supported on the floor 20. That is, such that the user's heels do not touch the floor 20. The textured surface of the exercise bench of the present invention is somewhat higher than seventeen inches, for example, about twenty inches or more, and preferably about twenty-three inches or more such that the user's legs are able to swing generally free of the floor to enable the user to perform exercises in accordance with the present invention. A height A of at least about twenty three inches would be sufficient for a large percentage of the adult population. In a preferred configuration, the width of the textured surface 24A, 24B, 24C is about twenty-three inches wide. This provides adequate width for thigh length plus a few extra inches for hand placement on the surface for support during exercises. Finally, the textured surface of the bench 10 is preferably about thirty-six inches long to allow for buttocks/hip girth plus a few extra inches for lateral rolling exercises and to provide front body support.

Preferably, the exercise bench 10 is stackable such that a quantity of exercise benches 10 may be stacked in a stable configuration for storage. It is also highly desirable that the bench is foldable and/or capable of being easily disassembled (see FIG. 1A) such that the bench 10 may be hidden out of sight, for example, under a bed or in a closet.

It is also highly desirable, as can be seen in FIG. 1, that the bench 10 have interchangeable textured surfaces 26A, 26B, 26C. As shown in FIG. 1 as an example, the textured surface 26A is removable from the frame 12 such that a different textured surface such as 26B or 26C may be attached using fasteners, for example, hook and loop fasteners 30. The textured surface 26A, 26B, 26C may be integral with the seating surface 16.

Finally, one or more storage containers (not shown) may be included in the bench for storage of, for example, ancillary exercise equipment.

The primary use of the bench 10 is for exercises directed to reducing cellulite on the buttocks and back of the thighs. FIG. 2 depicts an example of one such exercise. Here, a user 18 sits on the bench such that the user's feet 22 are elevated above the floor 20 upon which the bench 10 is located. The user's legs may freely swing upwardly to a stiff-knee position and outwardly. A particularly beneficial exercise is an exercise where the user's skin remains relatively fixed with respect to the textured surface 24A, 24B, or 24C but the fat tissue containing cellulite moves relative to the textured surface 24A, 24B or 24C. For example, as shown in FIG. 2, the user 18 may move her legs back and forth from an extended leg position (shown in phantom lines) to a bent position (shown in solid lines). Here, the user 18 sits on the bench and may grip the bench (as shown) and move the legs back in forth in this manner to create a rocking motion. Preferably this movement is done rapidly to create added friction, to increase the user's heart rate for additional exercise benefit and to provide for muscle strengthening. Similarly, rather than moving both legs at the same time, the user 18 may alternate movement of her legs, thereby providing a different beneficial massaging effect. The user may have also spread her legs widely or narrowly, using similar movements, to target different areas of cellulite. Substantially any exercise where the user's skin remains relatively fixed with respect to the textured surface 24A, 24B, 24C but where fat tissue containing cellulite moves relative to the textured surface 24A, 24B, 24C such that a massaging effect occurs is intended to be within the scope of the present invention.

Other body movements may be used so long as the massaging effect described above is accomplished. For example, the user may roll from side to side, perform sit-ups or crunches, and the like.

Additionally, the user may use ankle weights, as well known in the art of exercise, to increase the exercise effect of the exercise. Whether or not ankle weights are used, in addition to providing the benefit of the reduction of the appearance of cellulite, the present invention also provides muscle exercises that benefit, for example, the hip flexors, quadriceps, abdominals, lower back, etc.

In a particularly beneficial use of the present invention, the user proceeds with use of a series of, for example, three different textured surfaces 24A, 24B, 24C. These textured surfaces 24A, 24B, 24C each would provide different massaging effects to obtain the most beneficial exercise. The different textured surfaces 24A, 24B, 24C could be provided on, for example, three different benches 10, or could be provided on a single bench 10 having interchangeable textured surfaces 24A, 24B, 24C (see FIG. 2).

While the invention has been described in detail and with reference to specific examples thereof, it will be apparent to one skilled in the art that various changes and modifications can be made therein without departing from the spirit and scope thereof.

What is claimed is:

1. A method for the treatment of cellulite for the temporary reduction thereof, comprising the steps of:

(a) providing an exercise bench, comprising:

(i) a frame having legs;

(ii) a seating surface attached to the frame to support a body of a user, the seating surface located at a height above a floor upon which the frame is placed that is greater than about twenty inches such that an average user's feet do not fully touch the surface upon which the frame is placed; and (iii) a textured surface on the seating surface having a sufficient quantity and height of protuberances to enable reduction of cellulite when skin of the user is placed on the surface, the skin is kept relatively fixed relative to the textured surface, the body of the user is moved relative to the textured surface such that fat tissue is moved relative to the textured surface;

(b) moving legs of the user such that movement of the skin of the buttocks and thighs of the user's body supported on the seating surface remains generally fixed relative to the seating surface but providing for movement of fat tissue beneath the skin, thereby possibly decreasing viscosity of a subcutaneous fat layer of the user and increasing blood flow;

whereby cellulite of the user is temporarily reduced.

2. The method of claim 1, wherein movement of the legs is back and forth from an extended leg position to a bent position.

3. The method of claim 2, wherein movement of the two legs of the user occur such that the user's two legs are extended and bent simultaneously.

4. The method of claim 2, wherein the movement of each of the legs of the user occurs such that the user's two legs are extended independently and alternately.

5. The method of claim 1, including the step of placing leg weights on the user.

6. The method of claim 1, wherein the step of moving the legs includes moving the body of the user by rolling the body from side-to-side.

7. The method of claim 1, wherein the seating surface is located at a height above the floor of greater than twenty three inches.

8. The method of claim 1, including at least one fastener to allow for easy interchanging to a second textured surface.

9. The method of claim 8, including the steps of unfastening the textured surface, fastening the second textured surface, and repeating the step of moving the legs of the user.

* * * * *